US011457759B2

(12) United States Patent
Peplinski

(10) Patent No.: US 11,457,759 B2
(45) Date of Patent: Oct. 4, 2022

(54) TABLE LEG-MOUNTED HANDBAG HOOK AND METHODS OF USE

(71) Applicant: Joseph E Peplinski, Vail, CO (US)

(72) Inventor: Joseph E Peplinski, Vail, CO (US)

( * ) Notice: Subject to any disclaimer, the term of this patent is extended or adjusted under 35 U.S.C. 154(b) by 0 days.

(21) Appl. No.: 16/942,079

(22) Filed: Jul. 29, 2020

(65) Prior Publication Data

US 2021/0059453 A1 Mar. 4, 2021

Related U.S. Application Data

(60) Provisional application No. 62/892,383, filed on Aug. 27, 2019.

(51) Int. Cl.
*A47G 29/08* (2006.01)

(52) U.S. Cl.
CPC ..... *A47G 29/083* (2013.01)

(58) Field of Classification Search
CPC ..... A47G 29/083
USPC ..... 248/211, 213, 303, 305, 306, 307, 308, 248/322, 339, 304, 301, 630, 290, 98, 248/300, 558; 182/92
See application file for complete search history.

(56) References Cited

U.S. PATENT DOCUMENTS 409,239 A * 8/1889 Roller ..... A47G 25/08 248/304
1,473,016 A * 11/1923 Cook ..... A47C 7/64 248/304
3,773,288 A 11/1973 Bolton
4,088,294 A * 5/1978 Aliment ..... A47G 33/12 248/247
4,312,455 A 1/1982 Weber
4,925,142 A * 5/1990 Farmer ..... E04H 12/24 248/219.4
5,285,991 A 2/1994 Carlson
5,335,889 A * 8/1994 Hopkins ..... G09F 7/18 248/219.4
5,368,269 A * 11/1994 Boisseau ..... E04G 13/021 248/230.8
6,508,446 B1 * 1/2003 Addison ..... A47D 13/105 182/187
6,612,071 B1 * 9/2003 Steadman ..... A01G 17/04 248/525
6,991,203 B2 * 1/2006 Steadman ..... A01G 17/04 248/230.8
7,093,812 B1 * 8/2006 Nordeen ..... A45B 1/00 248/304
8,191,294 B2 * 6/2012 Lennard ..... G09F 7/18 40/607.13
8,418,808 B2 * 4/2013 Merritt ..... A63B 27/00 182/92

(Continued)

FOREIGN PATENT DOCUMENTS

DE 102015004184 A1 * 1/2016 ..... H02G 11/006
WO WO-2005075769 A1 * 8/2005 ..... A47G 29/083

*Primary Examiner* — Kimberly T Wood
(74) *Attorney, Agent, or Firm* — Riley Intellectual Property Law, LLC

(57) ABSTRACT

A hook system is described that can attach to the leg of a table and be configured to hold one or more purses, handbags, shopping bags or briefcases. The system is simple, inexpensive and adaptable to fit on legs of different sizes and shapes. The hook system can comprise one or more hook members and one or more adjustable cable ties to hold the hook members in place against a table leg.

10 Claims, 7 Drawing Sheets

(56) References Cited

U.S. PATENT DOCUMENTS

| | | | | |
|---|---|---|---|---|
| 10,599,163 | B2 * | 3/2020 | Wang | F04B 49/025 |
| 2005/0072746 | A1 * | 4/2005 | O'Brien | A47F 5/0823 211/59.1 |
| 2007/0187144 | A1 * | 8/2007 | Kato | B60R 16/0215 174/72 A |
| 2007/0247858 | A1 * | 10/2007 | Ford | F16M 11/04 362/382 |
| 2008/0245938 | A1 * | 10/2008 | Qualy | G09F 15/0037 248/218.4 |
| 2009/0146029 | A1 * | 6/2009 | Beatty | G09F 17/00 248/206.5 |
| 2010/0314514 | A1 * | 12/2010 | Nelson | F16M 11/08 248/219.1 |
| 2011/0198548 | A1 * | 8/2011 | Walker, Jr. | A01K 3/005 256/10 |
| 2013/0056602 | A1 | 3/2013 | Zivku | |
| 2018/0208134 | A1 * | 7/2018 | Uematsu | B60R 16/0215 |

* cited by examiner

TABLE LEG-MOUNTED HANDBAG HOOK AND METHODS OF USE

RELATED APPLICATIONS

The present application fully incorporates by reference and claims priority to U.S. Provisional Patent Application No. 62/892,383 filed on Aug. 27, 2019, which has the same title and same inventor as the present application.

BACKGROUND

A common problem faced primarily by women when frequenting a restaurant is determining where to place their handbag or purse. Placing it on the table can take up significant space and can get in the way of eating. Placing a bag on the floor subjects it to dirt and possible damage if inadvertently kicked. Placing it over a chair back by the shoulder strap is sometimes a solution, but depending on the chair design, the bag may slide off and onto the floor. Further, a bag placed over the seatback is often easy pickings for a thief. Men and women who wear hats face a similar problem concerning where to place their hat while eating.

Several solutions to this problem have been provided in the art, but nevertheless they suffer significant drawbacks. For instance, stand alone purse stands can be provided. These, however, tend to be costly and also tend to get in the way of the patron, whoever is sitting next to her especially if the table is on the smaller side, and servers who have to maneuver around the stand to access the table. Hooks are also known that attach to the edge of a table from which a bag can be hung from its straps or handle. Depending on the design of the hook and the configuration of a table's edge they may not work with certain table types. Some types of hooks could, over time, damage the edge of the table. Furthermore, the purse swinging at the tables edge could get in the way of the other patrons. Individual hooks can also be individually secured to an underside of a table bottom or the side of a leg, but these typically include screwing or nailing the hooks in place, which can cause damage and are time consuming to install.

DESCRIPTION OF EMBODIMENTS OF THE PRESENT INVENTION

Figure 1:
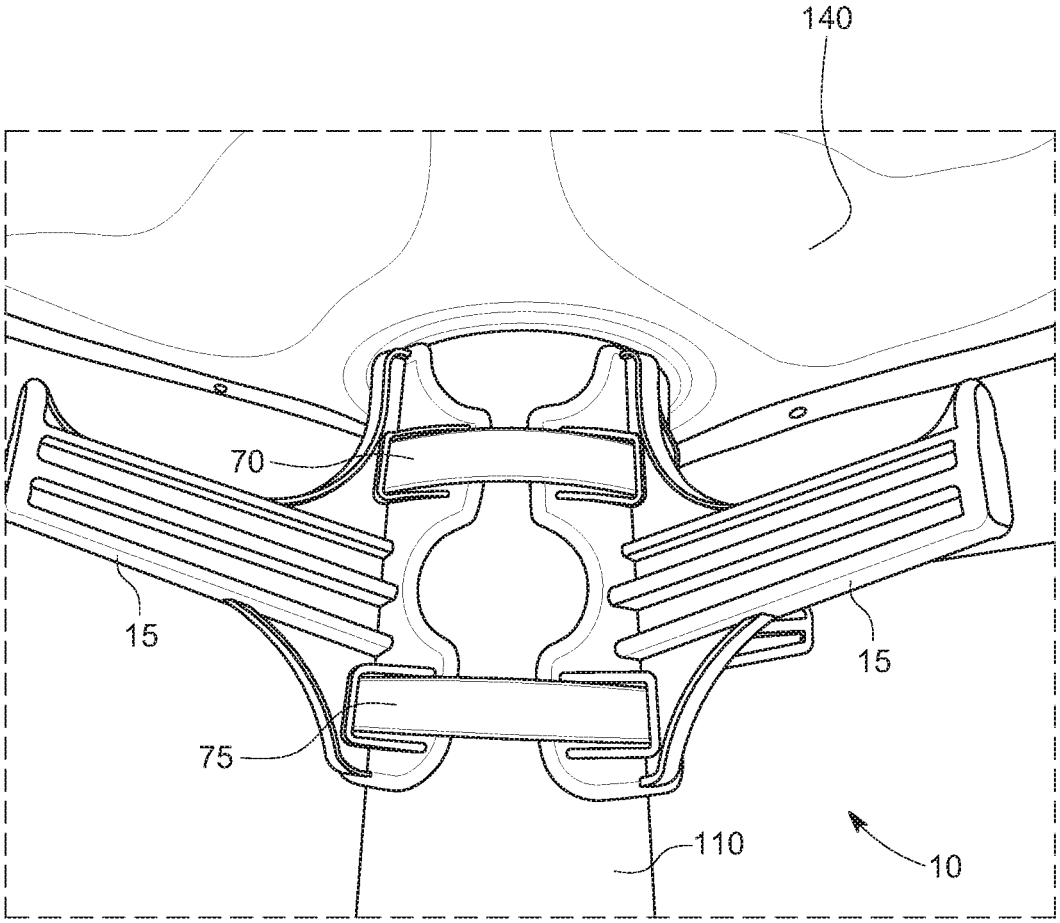
FIG. 1 is a perspective view of a typical center-leg restaurant table with a handbag hook system installed thereon according to one embodiment of the present invention.

A hook system is described that can attach to the leg of a table and be configured to hold one or more purses, handbags, shopping bags, hats, or briefcases. The system is simple, inexpensive and adaptable to fit on legs of different sizes and shapes. For instance, variations of the system can be utilized on both pedestal style table legs, as well as, corner table legs.

Embodiments of the hook system comprise one or more hook members and one or more adjustable cable ties to hold the hook members in place against a table leg. In some variations, the cable ties can be replaced by other types of adjustable circular clamps, such a ring clamp.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase, and other variations of the word.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The terms "approximately" and "substantially" as used in this specification and appended claims, refers to plus or minus 10% of the value given.

The terms "about" and "generally" as used in this specification and appended claims, refers to plus or minus 20% of the value given.

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiments and are not necessarily intended to be construed as limiting.

The term "unitary" as used herein refers to an item, component, element or other part that is made as a single piece, such as being integrally molded. Herein, one or more embodiments utilize a unitary hook member that is molded as a single piece.

An Embodiment of a Handbag Hook System

Figure 2:
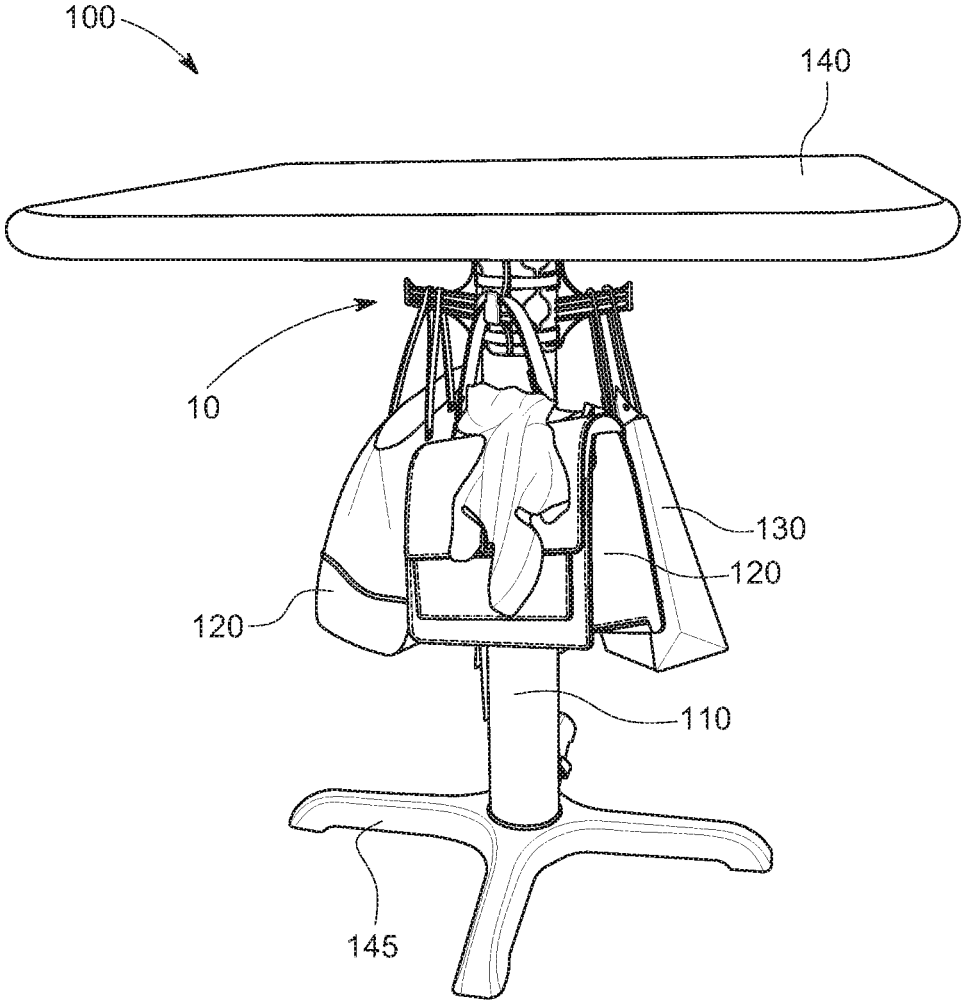
FIG. 2 is a perspective view of the handbag hook system installed on the pedestal-type restaurant table with handbags hanging from the hook according to one embodiment of the present invention.
Figure 3:
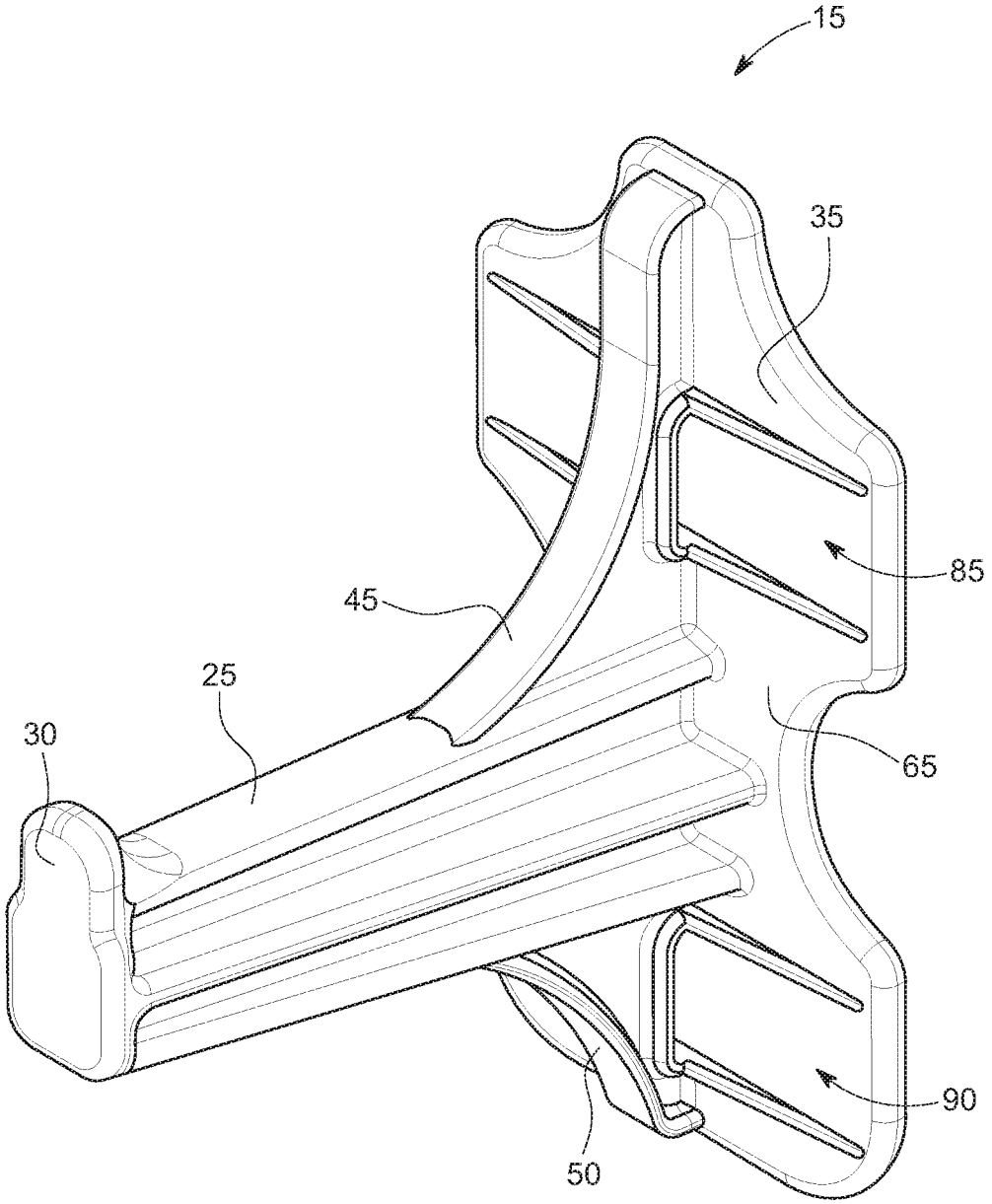
FIGS. 3-6 are side perspective, side, front perspective, and, back views of a hook member of the handbag hook system according to one embodiment of the present invention.
Figure 4:
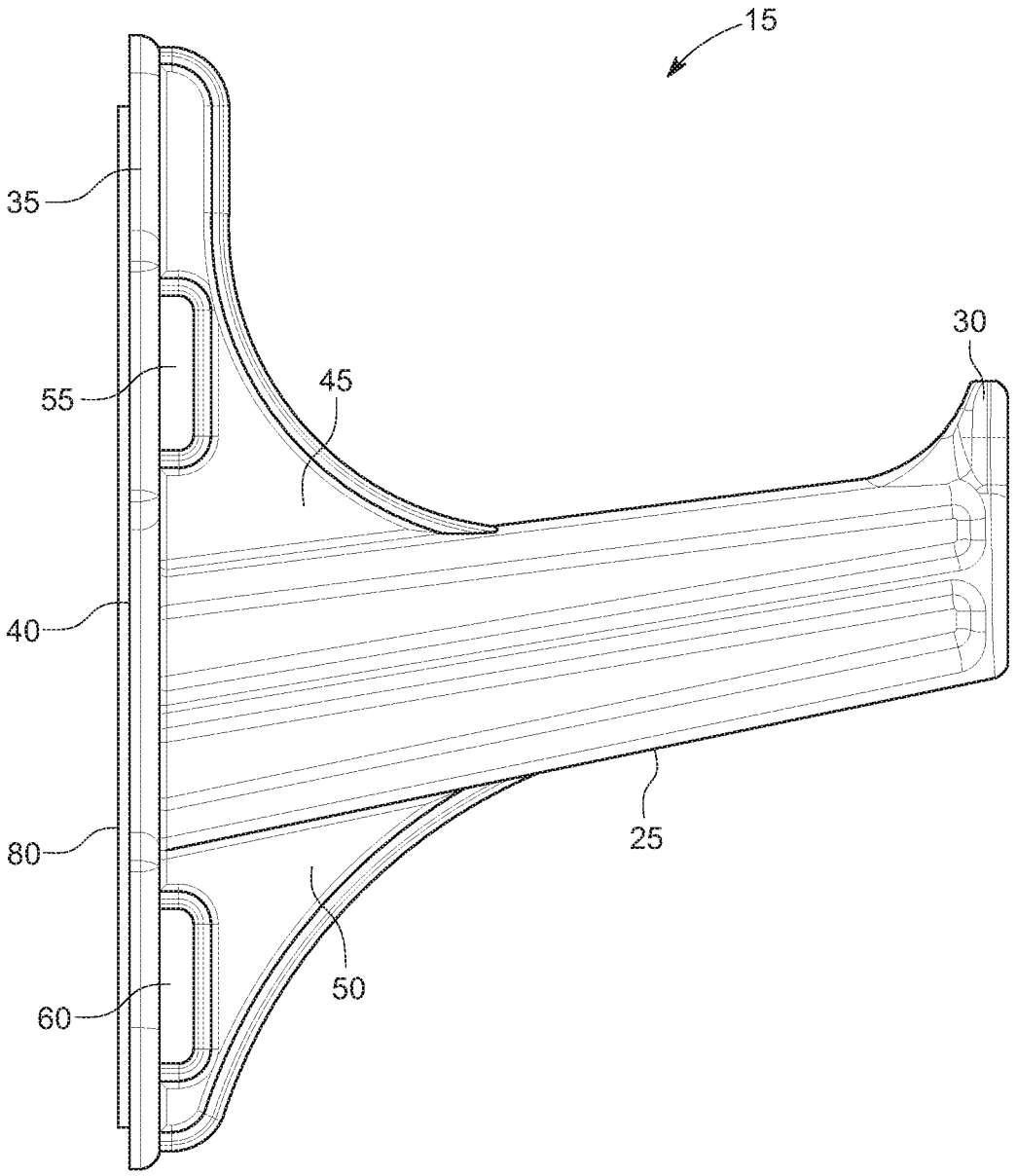
Figure 5:
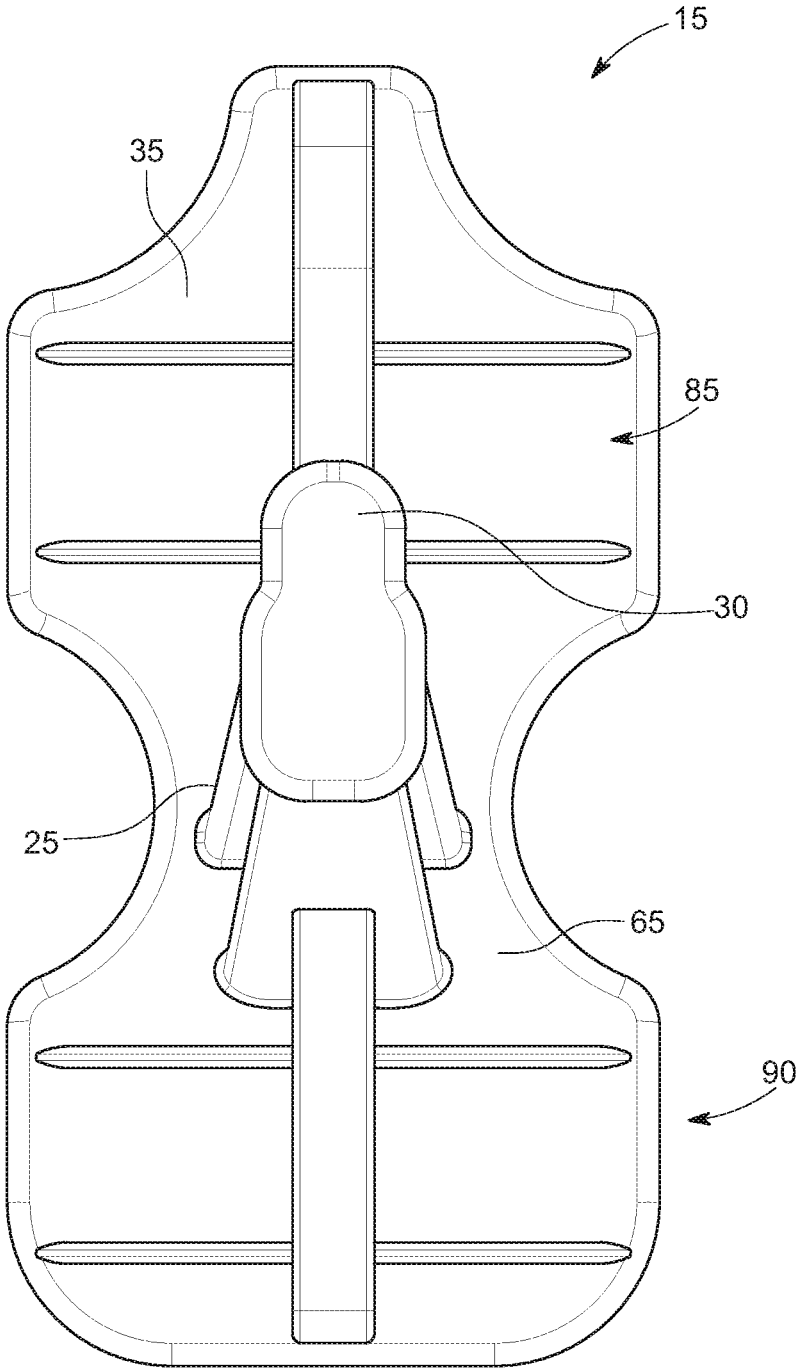

An embodiment of the handbag hook assembly (or system) 10 and the components thereof are illustrated in FIG. 1-7 and comprise one or more hook members 15 and one or more cable ties 70,75 to attach the hook members to a table leg by encircling it. FIG. 1 illustrates the system installed on the center leg 110 or pedestal of a table 100. As shown, a plurality of hook members 15 are secured to the leg. This facilitates hanging as least as many handbags 120 or shopping bags 130 therefrom as illustrated in FIG. 2. The hooks can also be used to hang hats and/or drape sweaters or sweatshirts thereover. As can be appreciated, when the system is attached to the center pedestal of an associated table, the bags and handbags are safely and conveniently tucked away underneath the table such that they are not easy targets for thieves and they do not get in the way of the restaurant patrons or servers.

The essential component of the handbag hook assembly 10 is the hook member 15. One embodiment of the hook member is illustrated in FIGS. 3-6. It is typically comprises an elongated post 25 that includes an upwardly pointed hooked distal end 30. The proximal end terminates at a relatively thin flared base 35, which typically includes a smooth planar or arcuate backside surface 40. The backside surface interfaces with and braces against an underlying surface of the table leg 110 in use. Top and bottom reinforcing gussets 45&50 extend between the base and the elongated post to further strengthen the interface therebetween. Top and bottom slots 55&60 extend through the top and bottom gussets proximate a frontside surface 65 of the flared base. The frontside surface may also have channels 85&90 formed therein on either sides of the respective slots. As clearly shown in FIG. 1, the slots permit top and bottom cable ties 70&75 to pass through the respective slots of each hook member while also being cinched against the frontside surface in the channels.

Still referring to FIGS. 3-6, the elongated post 25 can have any suitable configuration and cross section. For instance, it can be solid, it can be tubular, it can be round, it can be rectangular, or as illustrated, it can be a modified I-beam with an additional stiffening rib running down its longitudinal center. Essentially, the post should be sufficiently stiff and strong to hold the weight of a loaded handbag or shopping bag without breaking or flexing enough to allow the bag to slide off of the post. The actual shape is dictated by several factors including the strength and stiffness of the material from which it is constructed, the length of the post, the desired capacity of the hook member 15, and the method used to manufacture the hook member.

The length of the post 25 can also vary depending on the particulars of its intended use and load capacity, although a length of about 2-4 inches is typical. The height and dimensions of the hooked distal end 30 can vary as well but it typically extends upwardly a sufficient distance (about 0.25" or more) to hinder or prevent a bag from being knocked off of the post inadvertently, such as when hit with a leg. To further keep a handle of a bag on the elongated post, the post can be canted upwardly preferably at least 10 degrees and more preferably at least 15 degrees relative to horizontal when installed against a vertical table leg so that handle is encouraged towards the leg instead of the distal end of the elongated post.

Figure 6:
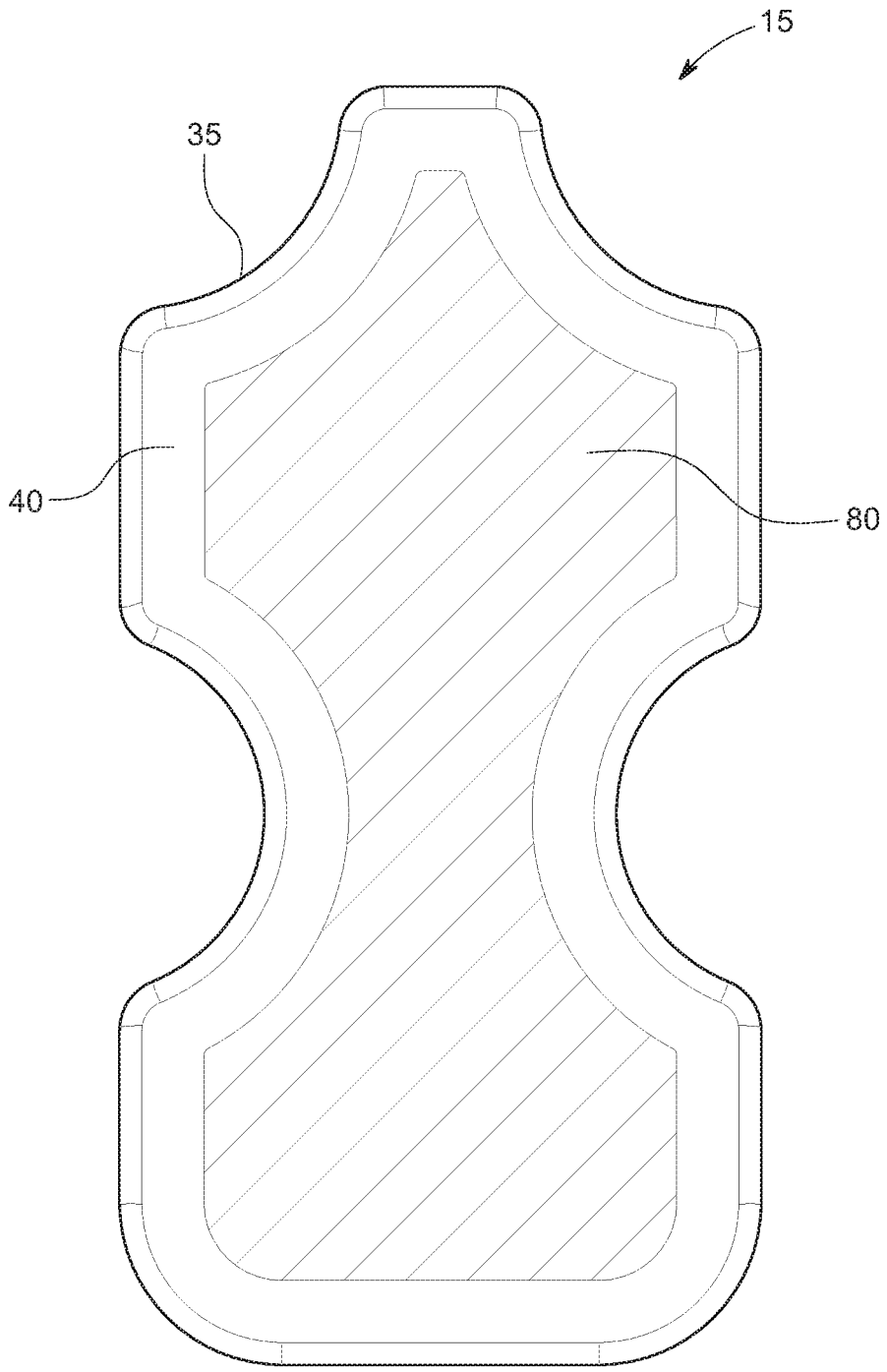

The flared base 35 of the hook member 15 can be relatively thin such that when a cable tie 70,75 or other clamp is tightened around it, it can flex to conform to the contour of the underlying surface of the table leg 110. In one variation the flared base is about 0.10 inches thick. Given this, the same hook member can be used with table legs of different diameters as well as square or rectangular table legs. The backside surface 40 as shown in FIG. 6 can be at least partially covered with a pressure sensitive adhesive patch 80 that is suitable for temporarily or permanently securing the hook member to a table leg. Accordingly, in one variation, the adhesive obviates the need to use cable ties to hold the hook member in place. In another, the adhesive is only suitable for holding the hook member in place for a short period of time when it is not laden with a handbag or other bag such that an installer can position the hook members in place before securing them with a cable tie or other clamp. In yet other variations, no adhesive is utilized and the hook member is held in place entirely with the cable ties.

The hook member can be made of any suitable materials and by any suitable means, but the is typically fabricated as a unitary piece from a polymeric material which may or may not be reinforced. At least one variation is made of a semi-rigid elastomeric thermoplastic material (or synthetic thermoplastic rubber) that when thin resiliently flexes but when formed into a more substantial shape, such as the elongated post 25, exhibits sufficient rigidity to support loads of about 10-20 pounds. One suitable material used in at least one variation comprises Avalon 60 DB Thermoplastic Polyurethane by Huntsman International LLC. Materials, such as this one, have a Shore D hardness of about 60, a flexural modulus of about 0.18 GPa, a tensile strength of about 43 MPa, and an elongation at break of about 350%. Typically manufacturing methods used to fabricate the hook include, but are not limited to, injection molding and 3D printing.

Figure 7:
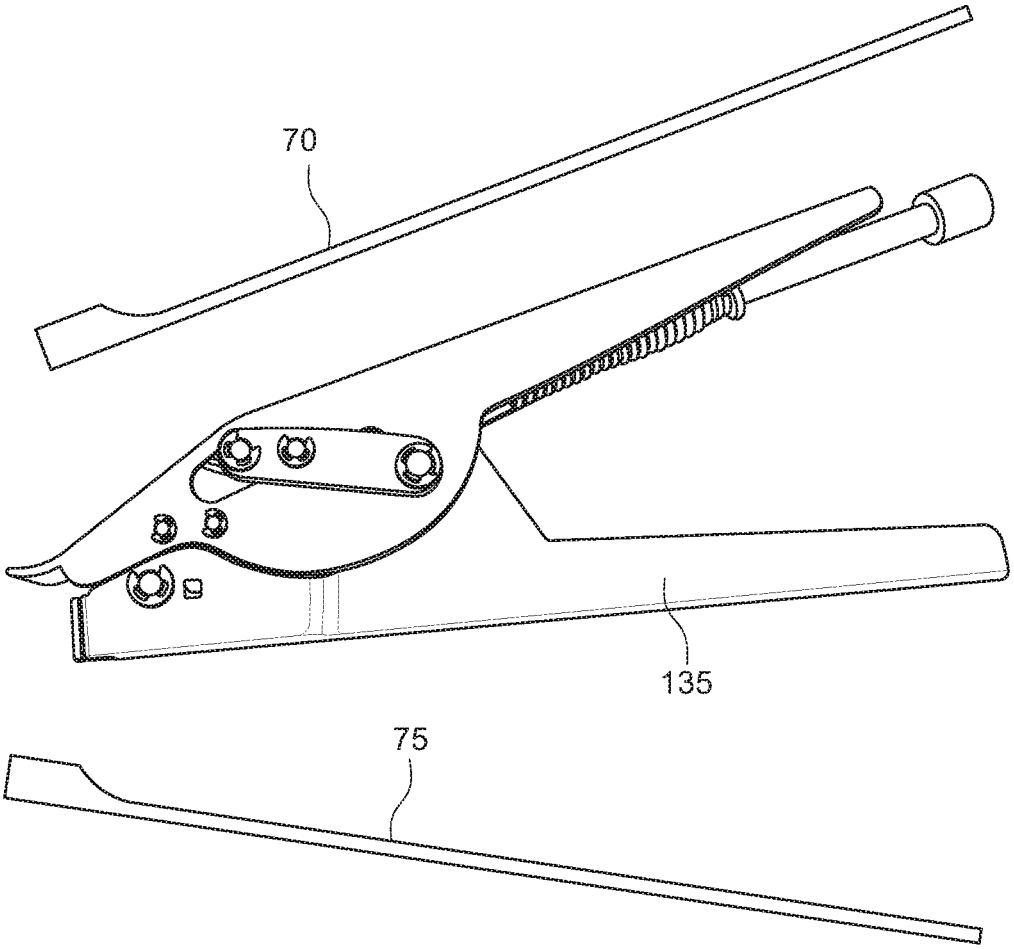
FIG. 7 is a perspective view of a pair of cable tie fasteners and an associated cable tie tightening tool according to one embodiment of the present invention.

As shown in the illustrated embodiment, the hook members 15 are attached to a table leg 110 using two cable ties 70,75. Two cable ties are illustrated in FIG. 7 along with a cable tie gun or tool 135 used to tighten a cable tie and then cut of the excess portion of the tie. Any cable tie of suitable dimensions can be used, although ties made of nylon or other higher tensile strength plastics may be preferred to better withstand the loads when bags are attached to multiple hook members all secured with the same set of cable ties. Although the embodiment of the handbag hook system illustrated herein uses two cable ties to hold the hook members to a table leg, other variations may use a single cable tie; whereas, other version may use more than two cable ties. As can be further appreciated other types of encircling or encompassing clamps can be used in place of cable ties, such as but not limited a wire, ring or hose clamp.

Installation of an Embodiment of a Handbag Hook System

Before installing a handbag hook assembly 10, an installer must first determine how many hook members 15 are to be installed around a particular leg 110 or legs of a table 100. For a table having a square leg, a hook member may be installed on each flat side using a set of the two same cable ties 70,75. For a round table leg depending on its diameter, several hook members may be distributed around the leg. On four legged tables, one or two hook members may be installed on each leg, such as on the back sides of each leg, so that a restaurant patron can choose a location to hang her purse that is close to her.

Once the number of hook members 15 are determined for the system that is to be installed, the installer then selects or verifies his/her cable ties 70,75 are sufficiently long to fully encircle the intended table leg 110. Ideally, the cable tie should have a length at least a few inches greater than the circumference of the leg to permit sufficient length for the cable tie tightening tool 135 to grab onto the tie during installation.

In some variations wherein the hook member 15 has an adhesive 80 attached to its backside surface, the hook members are positioned in place at the same vertical height on the leg. The cable ties 70,75 are then thread through the slots 55,60 on the various members, and loosely secured around the table leg 110. Finally, the cable tie tightening tool 135 is used to fully tighten the cable ties within the channels 85&90 on the frontside surface 65 of the flared base 35 and cut off the excess length of the ends.

In other variations wherein the hook members 15 do not have an adhesive backside surface, the cable ties 70,75 are thread through the hook members and then the whole assembly is positioned at the desired height on a table leg 110. The ties can be loosely fastened and the various hook members positioned as desired before the cable tie tightening tool 135 is used to fully tighten the cable ties and cut off the excess length of the ends.

Of significant note, the top 140 and/or base 145 of the table 100 need not be removed in installing the handbag hook assembly 10. If necessary, an installer can turn the table over to provide free access to the leg(s) or the installer can crouch under the table top.

Use of an Embodiment of a Handbag Hook System

Once installed a patron of a restaurant can hang his/her bags 120,130 from the shaft 25 of the hook member 15. The people sitting at the table 100 can place their bags or other suitable items, such as a hat, on a hook member located proximate their seating location. As necessary, the straps on the bags can be looped in a loose knot to reduce their effective length and permit the bag to be hung from the hook without touching the ground. Pedestal-type tables may have a single handbag hook system assembly installed around the center leg with a plurality of hook members spaced around the circumference of the leg. Four leg tables may have separate assemblies secured around the different legs with only one or two hook members being included in each assembly along the inside facing sides of the legs.

Variations and Other Embodiments

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A combination comprising:

a table comprising a table top and a table leg extending downwardly from the table top; and a hook assembly secured to the table leg, wherein the hook assembly comprises:

a unitary hook member configured to hold a purse, the unitary hook member comprising:

a flared base having a backside surface braced against the table leg and a frontside surface, wherein the flared base is resilient and flexible, and wherein the backside surface is substantially planar in an unflexed state;

a shaft having an elongated shape extending from a proximal end that terminates at the flared base to a distal end, wherein the shaft is rigid, and wherein the shaft is canted upwardly at an acute angle from the proximal end toward the distal end when the flared base is oriented vertically;

a hook disposed at the distal end of the shaft, wherein the hook is pointed upwardly from a top surface of the shaft;

a top gusset extending between the top surface of the shaft and the front surface of the base;

a top slot extending through the top gusset proximate the front surface;

a bottom gusset extending between a bottom surface of the shaft and the front surface of the base; and a bottom slot extending through the bottom gusset proximate the front surface of the base;

the hook assembly further comprising a first encircling clamp extending through the top slot and encircling the table leg and tightening the flared base to the table leg; and a second encircling clamp extending through the bottom slot and around the table leg and tightening the flared base to the table leg;

wherein the first encircling clamp and the second encircling clamp flex the flared base such that the backside surface conforms to a contour of the table leg.

2. The combination of claim 1, wherein the unitary hook member further comprises:

a first channel formed in the frontside of the flared base on opposite sides of the top slot; and a second channel formed in the frontside of the flared base on opposite sides of the bottom slot.

3. The combination of claim 1, wherein the first and second encircling clamps are cable ties.

4. The combination of claim 3, wherein the cable ties comprise nylon.

5. The combination of claim 1, further comprising an adhesive patch on the backside of the flared base.

6. The combination of claim 1, wherein the shaft has a cross section in the shape of an I-beam with a stiffening rib running along a longitudinal center thereof.

7. The combination of claim 1, wherein the hook assembly further comprises a second said unitary hook member secured to the table leg by the first and second encircling clamps.

8. A method of making the combination of claim 1, the method comprising:

placing the backside surface of the flared base against the table leg;

passing the first encircling clamp over the frontside surface of the flared base above the elongated shaft and through the top slot;

passing the second encircling clamp over the frontside surface of the flared base below the elongated shaft and through the bottom slot;

securing each of the first and second encircling clamps around and to the table leg; and tightening each of the first and second encircling clamps to secure the unitary hook member to the table leg.

9. The method of claim 8, wherein the hook assembly is installed without removing the table top from the table leg.

10. The combination of claim 1, wherein the table comprises a pedestal- type table.

* * * * *